US005281764A

United States Patent [19]

King et al.

[11] Patent Number: 5,281,764

[45] Date of Patent: Jan. 25, 1994

[54] METHOD OF MANUFACTURING COLOR CODED TWISTED PAIRS

[75] Inventors: William A. King; Donald Carter, both of Richmond, Ind.

[73] Assignee: Cooper Industries, Inc., Houston, Tex.

[21] Appl. No.: 884,574

[22] Filed: May 18, 1992

[51] Int. Cl.[5] ..... H01B 7/36

[52] U.S. Cl. ..... 174/112; 174/34

[58] Field of Search ..... 174/112, 34

[56] References Cited

U.S. PATENT DOCUMENTS 3,102,160 8/1963 Cook et al. ..... 174/112
3,650,862 3/1972 Burr ..... 174/112
4,128,736 12/1978 Nutt et al. ..... 174/112
4,158,746 6/1979 Taylor et al. ..... 174/112
4,629,285 12/1986 Carter et al. ..... 350/96.23

*Primary Examiner*—Morris H. Nimmo
*Attorney, Agent, or Firm*—Laff, Whitesel, Conte & Saret

[57] ABSTRACT

A color coded twisted pair and method of making. First conductor (12) and second conductor (16) are extruded with first insulating material (20) and piggyback extrusion technique is used to extrude a second insulating coating (21) different in color from said first insulating coating (20). Second insulating material (21) covers less than 90° but greater than 0° of said first insulated wire and second insulating material (21) covers more than 180° but less than 360° of said second insulated wire.

15 Claims, 2 Drawing Sheets

METHOD OF MANUFACTURING COLOR CODED TWISTED PAIRS

BACKGROUND OF THE INVENTION

This invention relates to color coding of electrical conductors, in general, and, in particular, color coding twisted pairs.

When manufacturing electrical wiring which contains more than one conductor, it is necessary to color code the conductors. Without color coding it would be necessary for the electrician installing the wire to perform a conductivity check to determine which wire at the first end was, in fact, the same wire at the other end of the cable, which may be remotely located.

Prior art color coding would often use a STRIPE or a band of a different color than the extruded insulated material on the wire. This brings draw backs in that two different extruded materials had to be used which often required two operations. The stripe or band had to be put on in a separate operation using ink or in some other fashion. Also, the ink would be subject to smudging at higher speed manufacturing.

SUMMARY OF THE INVENTION

A pair of twisted wires in a cable according to the present invention is extruded using a first color insulating material. A piggy back extruder using a second color insulating material, extrudes a band of second color material approximately greater than 180° less than 360° around a first wire, and a band of second color material approximately range of 0° to 90° around a second wire. This gives the appearance that the first wire has been striped with the first colored insulating material, and the second wire has been striped with the second color insulating material. This gives the appearance of a product which has two different base compound colors and two different stripe colors. The colors complement each other i.e., first insulated conductor, blue base color with white stripe, and second insulated conductor white base color with blue stripe.

DETAILED DESCRIPTION OF THE INVENTION

Figure 1:
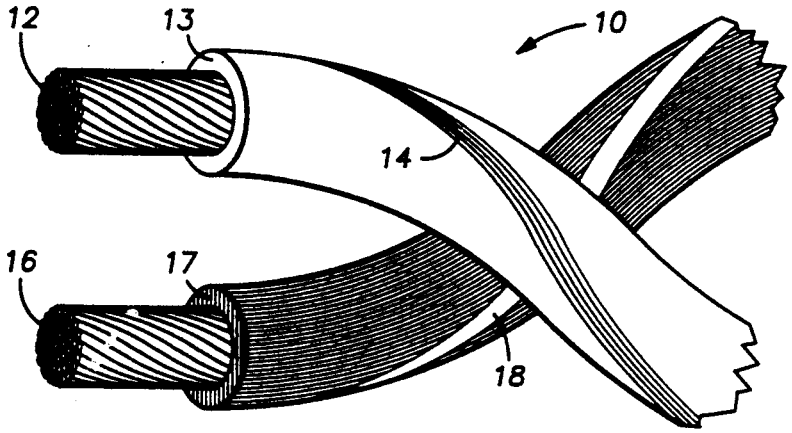
FIG. 1 (PRIOR ART)
FIG. 1 shows a perspective view of a prior art color coded twisted pair.

FIG. 1 shows a prior art twisted pair shown in general by Numeral 10. First electrical conductor 12 and second conductor 16 are encased in insulating material. Insulating material 13 surrounding first conductor 12 is white. A blue STRIPE 14 has been added to the exterior surface of insulation 13. Second conductor 16 is encased in a blue insulation 17 with a white stripe 18.

If a cable contained only one insulated pair it would be possible to determine one conductor from the other without the striping. However, cables often contain many twisted pairs, and it is difficult or impossible to determine the first end of one wire and match it with the second end of the same wire without some form of color coding. Also some specifications may require stripes of a particular color.

Figure 2:
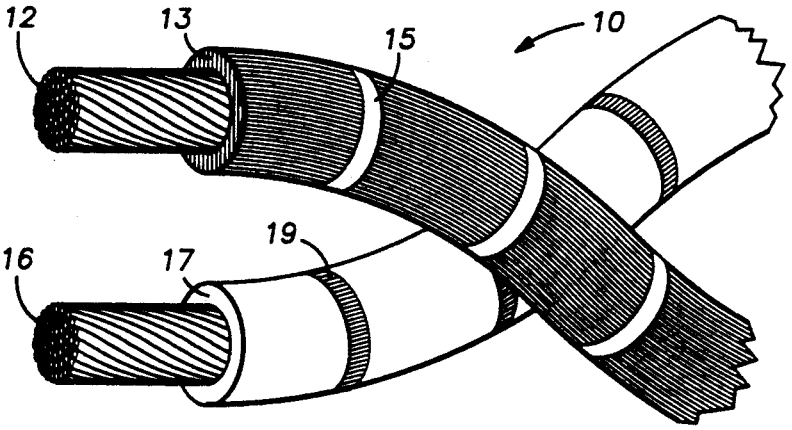
FIG. 2 (PRIOR ART)
FIG. 2 shows a prior art color coded twisted pair with ring stripes.

FIG. 2 shows another prior art twisted pair. First conductor 12 has a first insulation 13 surrounding the conductor. A white ring band STRIPE 15 is used to help identify individual strands of wire. Second conductor is covered with insulation 17 of a different color with a ring band STRIPE 19 of a material of the same color as insulating material 13 of the first conductor.

The ring band stripes 15 and 19, shown in FIG. 2, or the diagonal stripes 14 and 18, shown in FIG. 1, may be applied using ink jet printing or in other methods known to the prior art. These methods however add additional steps to the manufacturing process, and are not cost effective.

Figure 3:
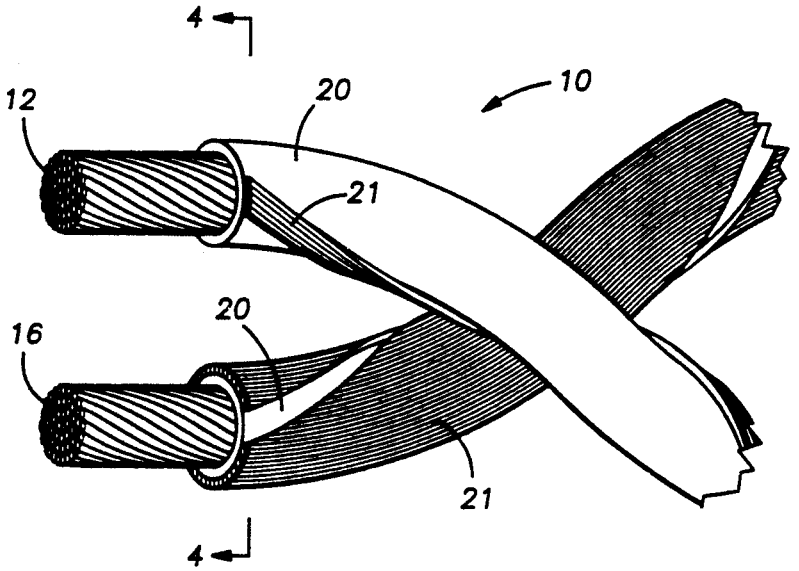
FIG. 3 shows a color coded twisted pair according to the present invention.
Figure 4:
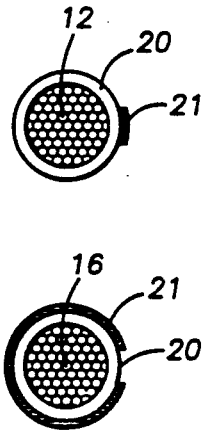
FIG. 4 shows a cross sectional view of the color coded twisted pair shown in FIG. 3.

FIGS. 3 and 4 show twisted pair according to the present invention. First conductor 12 is surrounded by a first insulating material 20 in this embodiment white insulating material. Second conductor 16 is also surrounded by first insulating material 20. First conductor has a layer or stripe of second insulating material 21 blue in this embodiment extruded on the first insulating material, which covers a portion of the circumference of the first conductor. In the preferred embodiment the extent of coverage of the second insulating material should be greater than 180° but less than 360°.

The second insulated conductor is also partially covered with a second insulating material around a portion of the circumference. In the preferred embodiment the extent of coverage of the second insulated conductor should be greater than 0° but less than 90°. FIG. 4 shows that the second insulating material is applied on top of the first insulating material. These drawings are not necessarily to scale and are illustrations to emphasize the coating technique. The two conductors are twisted together to make a twisted pair construction.

Figure 5:
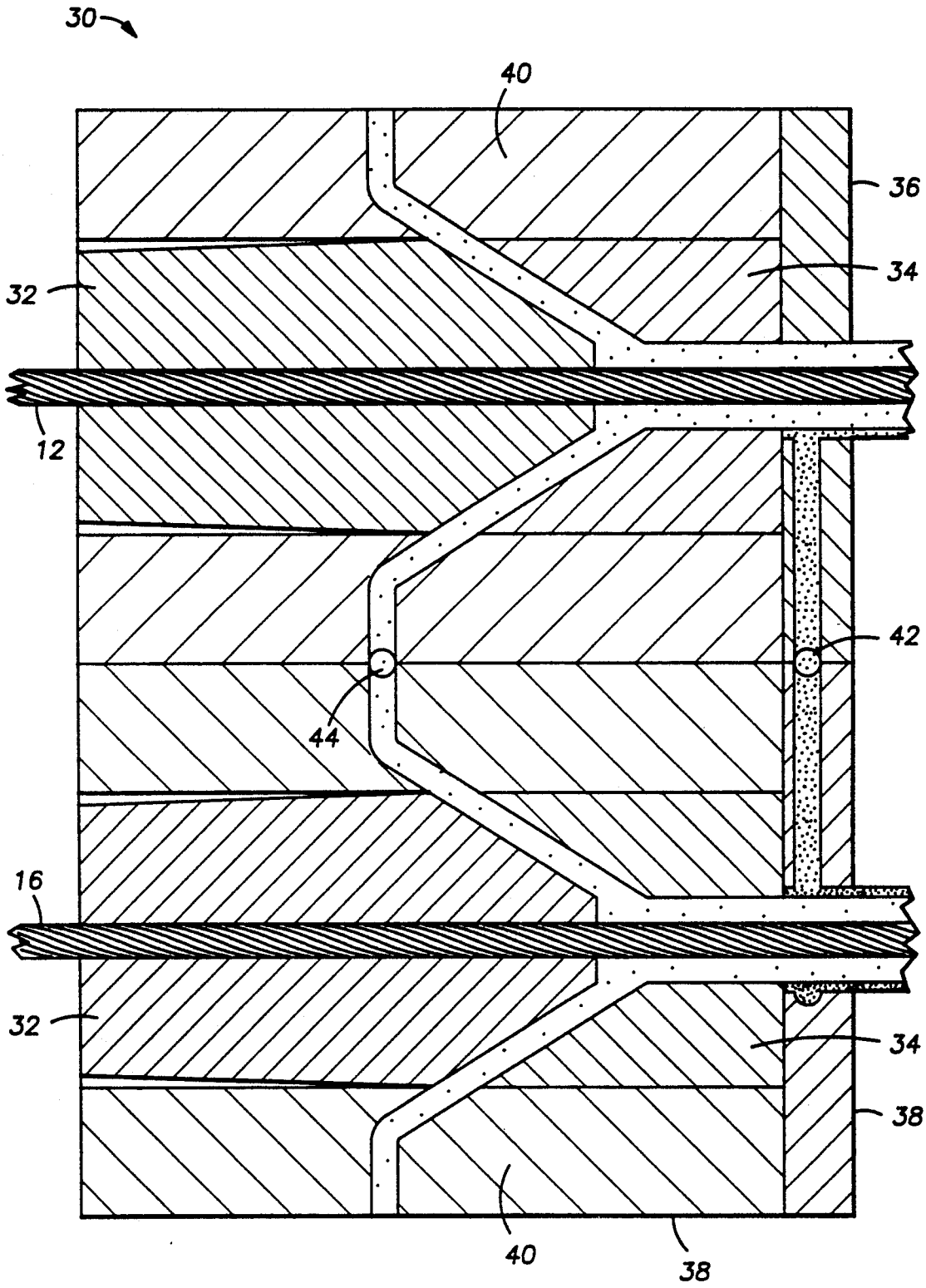
FIG. 5 is a cross-sectional view of an apparatus for manufacturing a color coded twisted pair in accordance with this invention.

As shown in FIG. 5, a pair of conductors 12 and 16 is extruded using a first color insulating material 44. A piggy back extruder using a second color insulating material 42 extrudes a band of a second color material approximately greater than 180° and less than 360° around the first conductor 16 and a band of the second color material 42 in approximately the range of 0° to 90° around the second conductor 12.

The final product will yield a twisted pair cable that appears to be made up of a blue insulated conductor with a white stripe and a white insulated conductor with a blue stripe. Yet as it is much lower in cost.

PARTS LIST

10 Twisted Pair
12 First Conductor
13 First Insulation
16 Second Conductor
17 Second Insulation
20 First Insulation
21 Second Insulation

I claim:

1. A pair of conductors, comprising:

a first conductor coated by a first insulating material;

a second conductor coated by said first insulating material;

said first conductor having a coating of a second insulating material extruded over said first insulating in an area approximately less than 90° but greater than 0° of a circumference of said first insulated conductor; and said second insulated conductor having a coating of said second insulating material over said first insulating material over an area approximately more than 180° but less than 360° of the circumference of said second insulated wire.

2. A pair of conductors as in claim 1 wherein said first and second conductors are twisted together.

3. A pair of conductors as in claim 1 wherein said first and second conductors are electrical conductors.

4. A pair of conductors as in claim 1 wherein said second insulating material covers approximately less than 25% of the circumference of said first insulated conductor.

5. A pair of conductors as in claim 1 wherein said second insulating material covers said second insulated wire in the approximate range of 50% to 100% of the circumference of said second insulated wire.

6. A pair of conductors as in claim 1 wherein said first insulating material has a different color from said second insulating material.

7. A pair of conductors as in claim 6 wherein said different colors are blue and white.

8. A pair of conductors, comprising:

a first conductor and a second conductor, each having a first coating of a first insulating material and a second coating of a second insulating material superimposed on the first insulating material; said first and second insulating materials being of different colors; said second coating on said first conductor covering between about 90° and 0° of the circumference of said first coating, and said second coating on said second conductor covering between about 180° and 360° of the circumference of said first coating; said first and second conductors being twisted together.

9. A pair of conductors as in claim 8 wherein said first and second conductors are electrical conductors.

10. A pair of conductors as in claim 8 wherein said first and second coatings are formed of an extruded material.

11. A pair of conductors as in claim 8 wherein said coating on said first conductor is in the form of a spiral stripe.

12. A pair of conductors as in claim 8 wherein at least three quarters of the outer surface of said second conductor is covered by said second coating and less than one quarter of the outer surface of said first conductor is covered by said second coating.

13. A method of making a pair of conductors, comprising the steps of:

extruding a coating of a first insulating material on an outer surface of a first conductor;

extruding a coating of said first insulating material on an outer surface of a second conductor;

extruding a coating on at least half of an outer surface of said first insulated conductor with a second insulating material; and extruding a coating on less than half of an outer surface of said second insulated conductor with said second material.

14. A method as in claim 13 wherein said coating steps include coating at least three quarters of said outer surface of said first insulated conductor with said second material and coating less than one quarter of said outer surface of said second insulating material with said second material.

15. A method as in claim 13 wherein said first insulating material has a different color from said second insulating material.

* * * * *